US005588891A

United States Patent [19]

Bardot

[11] Patent Number: 5,588,891

[45] Date of Patent: Dec. 31, 1996

[54] SWIM TRAINING DEVICE

[76] Inventor: James P. Bardot, 302 Cozumel, Laguna Beach, Calif. 92651

[21] Appl. No.: 589,422

[22] Filed: Jan. 22, 1996

[51] Int. Cl.[6] ..... B63C 9/115

[52] U.S. Cl. ..... 441/115; 434/254; 441/117

[58] Field of Search ..... 434/254; 441/114–118, 441/106, 119, 108, 113

[56] References Cited

U.S. PATENT DOCUMENTS 1,759,711 5/1930 Price ..... 441/113
1,932,708 10/1933 Phillips, Jr. ..... 441/113
2,876,468 3/1959 Fraebel et al. ..... 441/119
5,342,232 8/1994 Bardot ..... 434/254

*Primary Examiner*—Sherman Basinger
*Attorney, Agent, or Firm*—Francis X. LoJacono

[57] ABSTRACT

A improved swim training device for teaching a novice swimmer to swim that includes a pair of buoyancy units that are defined as a pair of interconnected jackets adapted to removably store a plurality of floatation cells. The jackets are adjustable to the size of the wearer and to the changing size of the jackets as selective floatational cells are removed, each jacket being formed from a single sheet of material having an inner cover sheet and a plurality of extended flap members that are adjustably arranged to be positioned over the stacked floatation cells for easy removal from the jacket.

8 Claims, 1 Drawing Sheet

SWIM TRAINING DEVICE

BACKGROUND OF THE INVENTION

1. Field of the Invention

The present invention relates generally to a training device for teaching children to swim and more particularly to an improved swim training device which includes a plurality of floatation cells that are removably secured within a pair of adjustably connected jackets which are formed having a plurality of flap members arranged for enclosing and securing the floatation cells within each jacket by means of a drawstring that is threaded through the flap members. The jackets are also adjustable to the size of the wearer.

The present invention is an improvement of U.S. Pat. No. 5,342,232 which was issued to James P. Bardot, the inventor of the present invention herein described.

2. Description of the Prior Art

Many types of swim training devices, which are also referred to as swim training aids, are presently in use. The list of such devices consists of buoyancy rings, floatational swim suits, floatational arm bands, water wings, back packs, float boards, and other personal floatational devices. Most of these floatation apparatuses provide means for buoyancy while a student develops swimming skills. Thus, there are many types of swim training aids that incorporate different structural and configurational arrangements. However, the structures of these training devices have features that often restrict their use.

These restrictions cause some devices to become awkward and bulky, thus interfering with learning, or do not teach skills directly pertinent to those needed for learning to swim. In essence, they can be self-defeating, causing anxiety, confusion, and loss of confidence in the swim training device and/or the student's own abilities. Ultimately, the student's safety is jeopardized when he/she must eventually forsake the last of these support devices while possessing only marginal swimming abilities.

Additionally, changing or replacing familiar flotation devices with new ones as the student develops often creates temporary setbacks, loss of confidence, and anxiety while the gap is bridged and the student must relearn using a new system.

Further in this connection, the following are United States patents that disclose various types of floatation devices.

- U.S. Pat. No. 1,252,842, LIFE PRESERVER to W. G. Richardson;
- U.S. Pat. No. 1,301,831, LIFE PRESERVER to H. W. Gain;
- U.S. Pat. No. 1,394,180, LIFE PRESERVER to A. P. Lundin;
- U.S. Pat. No. 1,538,627, SWIMMING DEVICE to B. Di Lauro;
- U.S. Pat. No. 1,552,603, FLOAT to B. A. Hawks;
- U.S. Pat. No. 1,704,368, LIFE PRESERVER to J. Murphy;
- U.S. Pat. No. 2,118,165, SELF INFLATING LIFE PRESERVER to E. T. Christopher et al;
- U.S. Pat. No. 2,871,491, SWIM TRAINER to J. Van Vorst;
- U.S. Pat. No. 3,140,549, SWIMMING INSTRUCTION GARMENT to D. J. Wayfield;

- U.S. Pat. No. 3,179,963, BUOYANT SWIMMING VEST to K. Peterson;
- U.S. Pat. No. 3,181,183, LIFE JACKET to M. R. Allen; and
- U.S. Pat. No. 3,903,555, SWIMMING AID to D. H. Busby.

The majority of these patented inventions relate generally to life preservers and swimming aid devices. However, these devices do not provide a simple means for progressively teaching swimming skills to a trainee that allow the trainee to develop at his or her individual rate.

SUMMARY AND OBJECTS OF THE INVENTION

The present invention comprises a pair of buoyancy units defined by a pair of jackets that are adapted to receive and store a plurality of removable floatation cells or panels. The two jackets are attached together by means of an interconnecting adjustable drawstring or other suitable adjustable connecting means, whereby the two buoyancy units can be mounted about an individual's chest.

One unit is positioned over the chest area and the other unit is positioned over the back area of the swimmer. By removing selective floatation cells one can gradually learn how to swim with confidence. By selectively removing the floatation cells or panels one can control the swimmer's position in the water from a vertical stance to either a reclining supine position or an inclined prone position. This arrangement allows the swimmer to learn various types of swimming strokes in either the prone or supine position.

It is an important object of the present invention to provide a training device that allows a novice swimmer the ability to quickly learn the basic strokes while at the same time quickly establishing self-confidence in the ability to float freely without the aid of others.

Still another object of the invention is to provide an apparatus for teaching and training an individual to swim using a pair of floatational jackets. The inner surface (side nearest the wearer) of each pouch is made of a nonstretchable sheet of nylon or other suitable nonstretchable material formed having a plurality of flap members that are arranged to extend outward of the nonstretchable sheet so as to be positioned over the floatational cells or panels, whereby the cells are securely stacked within the respective jackets by means of a drawstring arrangement. This arrangement of the jackets also reduces the hydrodynamic drag and increases the performance of the training device and the wearer.

Yet another object of the present invention is to provide an apparatus of this character that includes a means for securing the pouches in a relatively fixed position to the torso of the wearer so as not to interfere with body movement or mobility while in the water.

A further object of the invention is to provide an improved training device of this character that is simple to use and not complicated in its structure, allowing for the simple removal to each floatational cell as the wearer progresses in his or her swimming skills. The exact amount of buoyancy required is always provided down to the final few ounces, allowing, safe, predictable, and reliable progression to free swimming.

A still further object of the invention is to provide an improved training device of this character which allows the jackets to be easily positioned on the front or rear of the student's body, whereby the jackets can be adjusted so as to position the wearer from a vertical mode to either an inclined supine mode or an inclined prone mode.

It is still a further object of the present invention to provide an improved swim training device of this type that is relatively inexpensive to manufacture, is simple but rugged in construction, and is easy to maintain.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

DESCRIPTION OF THE PREFERRED EMBODIMENT

Figure 1:
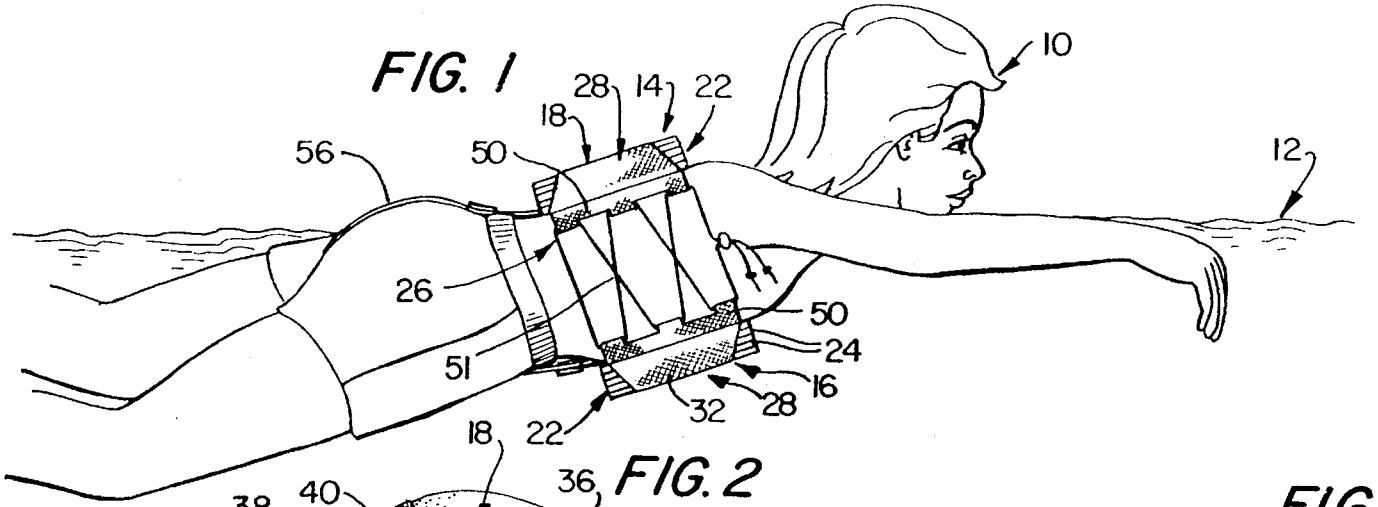
FIG. 1 is a side elevational view showing a novice swimmer in a prone position wearing the present invention mounted on the upper torso about the chest and back.

Referring first to FIG. 1 of the drawings, there is shown a novice swimmer, generally indicated at 10, swimming in a typical prone position in a body of water, designated at 12. The present invention is shown mounted around the wearer's upper torso and defines a swim training device, indicated generally a 14, for the non-skilled swimmer. The swim training device 14 comprises a pair of buoyancy units which are respectively numbered 16 and 18. These units are made identical to each other and their structure is the same so that the description of one will suffice for both units. Since the buoyancy units are the same in all respects, this allows the wearer to position units 16 and 18 as desired without concern as to which unit is positioned on the front (chest) and which goes on the back. However, when the individual units are first floatationally arranged they are each provided with floatational means 22 which comprise a given number of floatational cells 24 arranged and determined within each unit according to the size and weight of the one that is to use the training device.

For simplicity, unit 16 is shown positioned over the wearer's chest and the second unit 18 is located on the wearer's back. The two buoyancy units are interconnected by a body securing means, designated at 26, which allows training device 14 to be positioned and adjusted about the upper body of the wearer, as illustrated in FIG. 1.

Each unit 16 and 18 comprises a jacket 28 that is designed to removably support the plurality of floatational cell members 24. Jacket 28 is defined by a single inner cover sheet 30, preferably made from a suitable nylon material, which is arranged to be positioned for engagement with the swimmers chest or back, as indicated in FIG. 1. Inner cover sheet 30 is formed with a plurality of tapered flap members 32 that extend outwardly from the four respective sides 34, 35, 36 and 38 of cover sheet 30. The flap members are disposed adjacent the peripheral edges of the cover sheet and are formed in substantially triangular configurations to define a storage compartment.

Accordingly, cover sheet 30 together with the integrally formed flap members 32 define a means for enclosing the floatational cells within jacket 28. Each free end of flap member 32 is formed having an eyelet means defined by a closed looped end 40 which is part of a securing means 42 which also includes an elastic cord 44 that is threaded through each respective closed looped end 40. The elastic cord is provided with a holding means 45 that allows the elastic cord to be loosened, whereby the floatational cells can be inserted into the jacket and arranged in a proper sequential order so as to define each floatational unit 16 and 18.

Accordingly, securing means 42 allows easy access into jacket 28, whereby the floatational cells 22 may be stored in or removed from each of the buoyancy units 16 and 18 as during the training program of the individual so as to provide an uninterrupted training sequence.

Each floatational unit is arranged to receive floatational cells or panels 22, wherein each cell is formed having a substantially rectangular configuration and a size preferably between six to seven inches in width, approximately nine to ten inches in length, and a thickness of at least a quarter of an inch. One of many suitable cellular foam materials can be used as the cell structure. Further, each floatational cell or panel is provided with a sequential marking such as numerals or letters. The marking provides an aid in the method of training a novice to swim.

Figure 2:
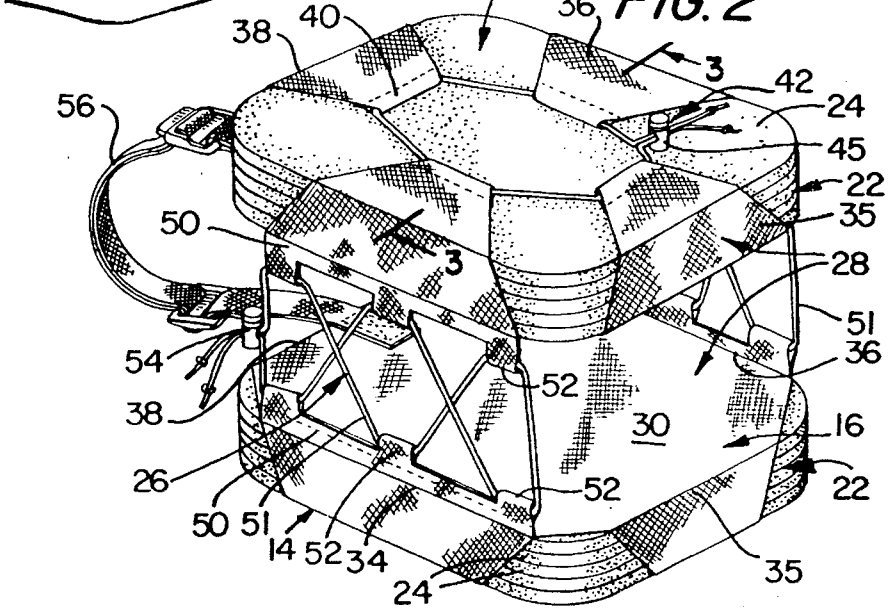
FIG. 2 is a pictorial view of the two jackets spaced apart and connected by the adjusting drawstring and further showing the position of the floatational cells securely mounted therein.
Figure 3:
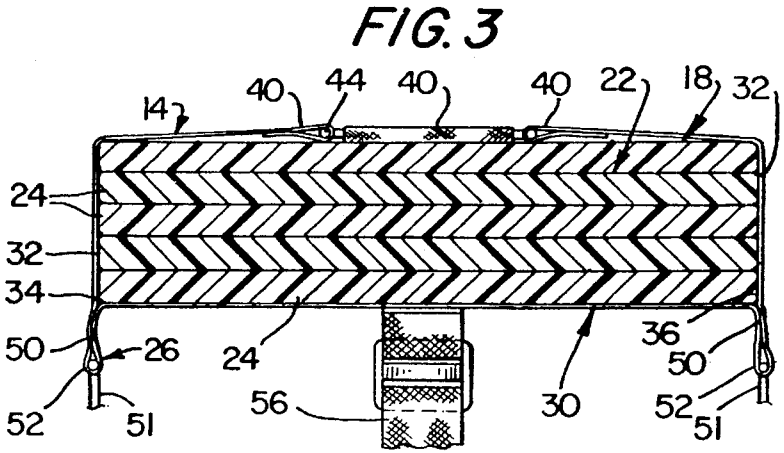
FIG. 3 is an enlarged cross-sectional view taken substantially along line 3—3 of FIG. 2, showing the floatational cells stacked and secured within the jacket.

In the embodiment, as indicated in FIGS. 1, 2 and 3, body securing means 26 comprises a pair of extended members 50 that are integrally formed as part of the elongated sides 34 and 36 of each respective jacket and are disposed between sheet 30 and flap members 32. There are three loop members 52 shown formed in extended member 50 along the opposite sides of the jackets 28 of each oppositely disposed unit 16 and 18 which are interconnected by means of an elastic drawstring or cord 51 which is laced through loop members 52 in a crisscross arrangement. Accordingly, the elongated sides of the interconnected buoyancy units 16 and 18 include aligned loop members 52 and the elastic cord 51 for adjusting the two buoyancy units firmly in place about the body of the swimmer 10, as illustrated in FIG. 1. Once adjusted, the two oppositely disposed cords 51 are provided with a holding means, designated at 54, that secures the cords in a tight fixed arrangement, whereby the jackets are held in place under the elastic force of cords 51.

An adjustable strap 56 is also provided to prevent the two buoyancy units 16 and 18 from sliding upwardly over the shoulders of the trainee during the swimming lessons. The adjustable strap is attached at each end to the respective jacket as illustrated in FIGS. 1 and 2.

As the trainee progresses in his or her skills, a selected number of floatational panels are removed so that the swim trainee proceeds from a passive buoyancy to a natural unaided condition without the wearer's conscious awareness. In essence, the wearer is self-taught to swim.

Since, the floatational panels are sequentially numbered or otherwise identified, the exact buoyancy measurement can be adjusted to the trainee's initial buoyancy and swimming ability, which contributes to maximizing the trainee's learning and personal comfort.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What I claim is:

1. An improved swim training device arranged to be worn about the upper torso of a swim trainee, said training device being defined by a pair of buoyancy units comprising:

a jacket formed from a single sheet of material that is arranged to define a storage compartment;

a plurality of floatational cells removably stored in said storage compartment so as to sequentially control the buoyancy of each of said buoyancy units;

said storage compartment being defined by an inner cover sheet arranged to engage the body of the swim trainee, wherein said inner cover sheet includes four peripheral edges with each edge formed having an outwardly extended flap member so as to define a free end with an eyelet formed therein;

means for removably securing said floatational cells in said jacket;

means for adjustably positioning said extended flap members over said floatational cells, as said floatational cells are selectively removed from within said storage compartment; and means for attaching said pair of buoyancy units to each other, said attaching means further defining means for securing said training device about the body of the wearer thereof.

2. The improved swim training device as recited in claim 1, wherein said eyelet is defined by a closed loop formed on said free end thereof.

3. The improved swim training device as recited in claim 2, wherein each of said flap members is formed having tapered side edges to provide a substantially triangular configuration.

4. The improved swim training device as recited in claim 3, wherein said means for removably securing said floatational cells in said jacket and means for adjustably positioning said extended flap members over said floatational cells comprise:

a drawstring laced through said eyelets; and a holding means operably mounted on said drawstring, whereby said floatational cells are tightly held in place within said jacket.

5. The improved swim training device as recited in claim 4, wherein said attaching means and said securing means comprise:

a plurality of loop members located along opposite outer sides of each of said jackets and extending outwardly from said inner cover sheet;

a drawstring laced through said loop members in a crisscross arrangement on each side of said jackets, whereby said buoyancy units are held firmly against the body of the trainee; and locking means mounted on said drawstring, whereby said drawstring is held in a selected tight arrangement, causing said buoyancy units to snugly fit the wearer thereof.

6. The improved swim training device as recited in claim 5, wherein said drawstrings are elastic cords.

7. A swim training device as recited in claim 6, wherein said floatational cells are sequentially marked with indicia.

8. A swim training device as recited in claim 7, wherein said indicia is defined by numerals or letters, whereby the adding or subtraction of said marked floatational cells provides a measured and monitored progression of the skill level of the trainee.

* * * * *